United States Patent [19]

Matuck et al.

[11] 3,941,231

[45] Mar. 2, 1976

[54] RIBBON CARTRIDGE

[75] Inventors: George Coleman Matuck; Gerald Carl Sienkiewicz; William Duncan Thorne, all of Raleigh, N.C.

[73] Assignee: International Business Machines Corporation, Armonk, N.Y.

[22] Filed: July 3, 1974

[21] Appl. No.: 485,654

[52] U.S. Cl. ..... 197/151; 197/172; 226/90; 226/195

[51] Int. Cl.[2] ..... B41J 35/04

[58] Field of Search..... 35/35 C, 8 A; 197/151, 197/153 R, 160, 168, 172, 180, 181; 226/90, 91, 195, 196; 360/93

[56] References Cited

UNITED STATES PATENTS

| | | | |
|---|---|---|---|
| 3,309,037 | 3/1967 | Amos | 242/67.3 |
| 3,621,968 | 11/1971 | Kondur | 197/172 X |
| 3,830,351 | 8/1974 | Cappotto | 197/151 X |

*Primary Examiner*—Edgar S. Burr
*Assistant Examiner*—Vance Y. Hum
*Attorney, Agent, or Firm*—Edward H. Duffield

[57] ABSTRACT

A ribbon cartridge for an endless loop inked ribbon suitable for use with a wire matrix printer, for example, is disclosed in which the cartridge includes elongated guide members to confine the path of the loop of ribbon outside of the cartridge to a predetermined path and to allow for insertion of the cartridge into a using machine without the necessity of threading inky ribbon through fixed guides on the machinery.

1 Claim, 5 Drawing Figures

FIG. 2
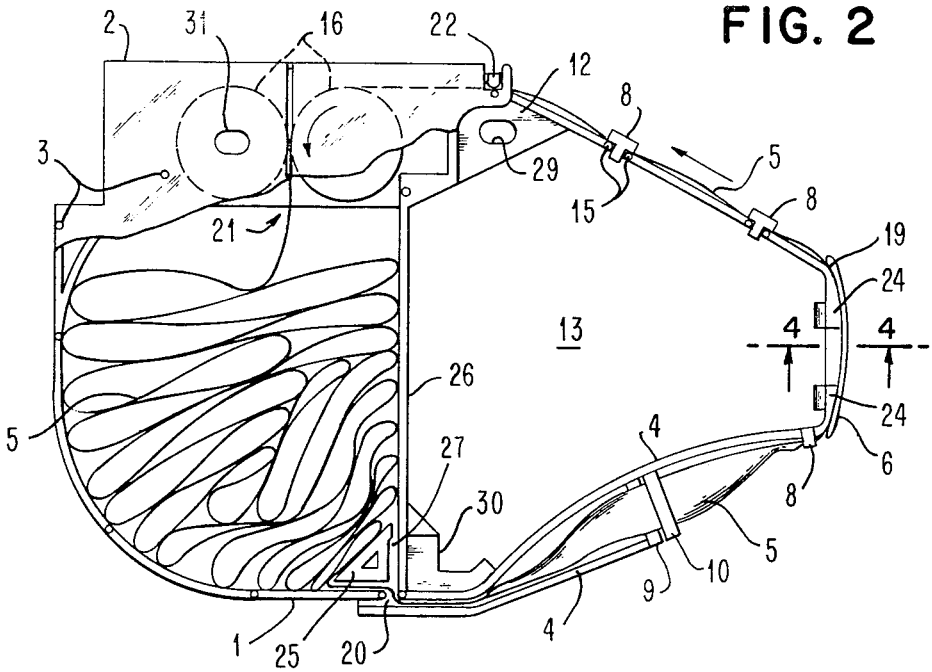
FIG. 3
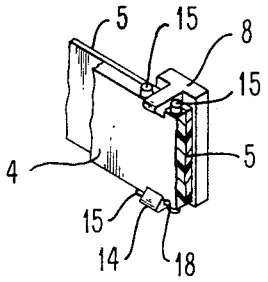
FIG. 4
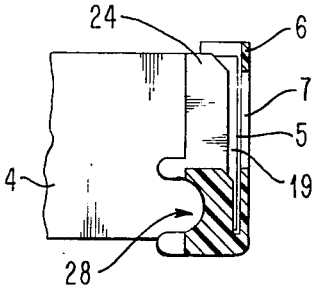
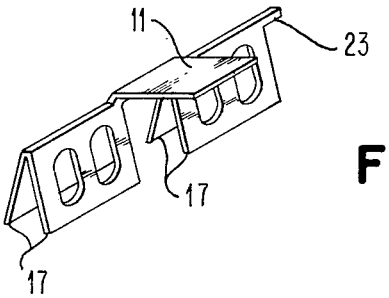
FIG. 5

RIBBON CARTRIDGE

FIELD OF THE INVENTION

The invention relates generally to ribbon, film, tape and other similar web, roll or loop containers in the cassette field and more specifically to inked ribbon cassettes for printers in which an endless loop of inked ribbon is contained.

PRIOR ART

The use of cassettes for storing inked ribbon of the type utilized in printing machines is well-known in the prior art. U.S. Pat. Nos. 3,621,968, 3,758,012, 3,726,381, 764,342, 539,683, and 2,685,357, 3,032,287, 3,002,670, 3,420,425, 2,679,394, 3,460,666 and 3,543,983 being general examples. Also, the use of an endless loop of ribbon for printing is well-known as is shown in the aforementioned U.S. Pat. Nos. 3,621,968 and 3,758,012. It is also well-known to apply a twist in the ribbon to form a Mobius loop, so that both sides of the ribbon will be utilized, as is shown in the aforementioned U.S. Pat. Nos. 3,460,666, 3,621,968, and 2,685,357, for example.

A common feature of all the foregoing prior art is that outside of the cassette body, the portion of tape which is in position for use with the printing or recording mechanism as the case may be, must be threaded manually through guides affixed to the printing or recording machinery. Particularly in the case of inked ribbon, this has been a messy and unpleasant task for the operator who changes the cassette periodicly when the ribbon loses its printing quality. In the confined spaces in which the operator generally must work, the task of threading an inky ribbon through several guides and holders becomes increasingly difficult.

OBJECTS OF THE INVENTION

In light of the foregoing difficulties with the prior art, it is an object of this invention to provide an improved ribbon cassette for printing machinery which eliminates the necessity of stringing the external portion of the loop of ribbon from the cassette through guides in the machine.

It is a further object of this invention to provide an improved, endless loop, print ribbon cassette for a printer which has a continuous guide means external to the main body of the cassette for guiding the printing ribbon out of the cassette past the printing area and back into the cassette without the necessity of having an operator load the ribbon into the guideways.

SUMMARY OF THE INVENTION

The foregoing and other objects of the invention are met by providing a ribbon cassette which has, as an integral part thereof, elongated continuous guideways for confining the external path of the ribbon to a predetermined geometry. The guides hold the ribbon in the proper orientation for the printing mechanism and guide the ribbon from its exit point from the cassette in a confined path to a printing area and then back to the cassette through drive rollers. The drive rollers are used for withdrawing the ribbon from the cassette at one end of the loop and stuffing it into the cassette at the other end. Means are provided with the cassette for automatically loading a portion of the loop between drive rollers affixed to the machine without necessitating its operator's use of fingers or other tools.

BRIEF DESCRIPTION OF THE DRAWINGS

FIG. 2 is a top plan view, partially cut away to show the interior of the cassette in FIG. 1.

FIG. 3 is a partial section of a guide such as shown in FIGS. 1 and 2.

FIG. 4 is a section taken through the printing exposure area of the guide in FIG. 2.

FIG. 5 is a pictorial view of tab 11 as partially shown in FIG. 1.

Turning to FIG. 1, a preferred embodiment of the invention will be discussed. As shown in FIG. 1, a typical cassette consists of a main body molding 1, which may be of plastic or other suitable easily formed and inexpensive material, which is fitted with a cover 2. Cover 2 may be held in place by a plurality of projections 3 which are integral with main molding 1 and which may be headed over, or flattened, or it can be built with snap closure fittings to effectively hold cover 2 to main body portion 1. Extended guide members 4 are preferably integral with body 1 and provide a pathway and guide means for the endless loop of inked ribbon 5 which emerges from the cassette at one side at an aperture 20. The ribbon 5 then traverses a guideway across a printing area or nosepiece 6. This area contains a printing aperture portion 7 to expose the ribbon to a printing medium on one side of nosepiece 6 and to a printing apparatus positioned on the other side of nosepiece 6. Nosepiece 6 also serves as a ribbon shield to keep the paper which is to be printed on from contacting the ribbon other than when the ribbon is forced through aperture 7.

Figure 1:
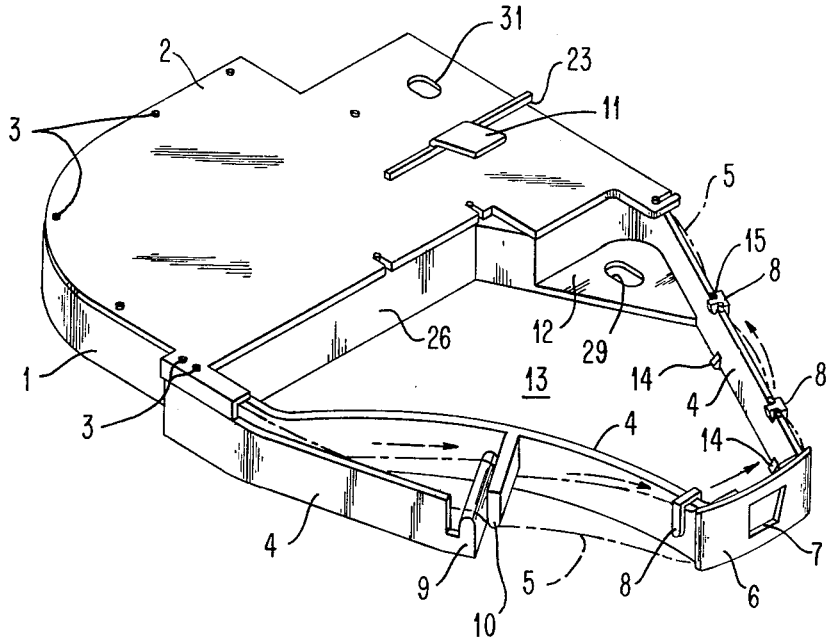
FIG. 1 is a pictorial view of a cassette for a printing machine, the cassette being a preferred embodiment of the present invention.

Individual U-shaped clips or guides 8 confine ribbon 5 to follow the contours of molded guides 4. A 180° twist on the longitudinal axis is imparted to ribbon 5 at its manufacture and is maintained by the ribbon guides 9 and 10 molded as integral parts of guide way 4. The ribbon 5 moves in the direction of the arrows as shown on the surface of the guide member 4 in this example. A removable plastic spacer or tab 11 is fitted in an aperture in cover 2 and passes through to the underside of cover 2. Tab 11 can be seen to greater advantage in FIG. 5. Molded webbing 12 and reinforcement in the corners of the moldings of the guideways 4 provide rigidity for the guide for the entire path of the loop of ribbon 5 external to the main body of the cassette 1.

With the external pathway for ribbon 5 thus predetermined and confined, the entire cassette may be loaded into a printing machine with the printing head apparatus in aperture 13 defined by the boundaries of guideways 4 and wall 26 of main body 1. The printing hammer or, in the preferred embodiment a wire matrix print head, would have its operative print elements positioned adjacent to aperture 7 on the back side of ribbon 5 so that the ribbon might be impacted in area 7 and forced against a printing medium, not shown.

All that a human operator need do to insert a fresh ribbon cassette would be to remove the old cassette, complete with the guideways 4 and its used ribbon 5, and insert a new cassette 1 in place. Since guideways 4 and the guide clips 8, together with guide channels in the nosepiece 6 as shown in FIGS. 2 & 4, are provided integrally with the cassette 1, there is no need for the operator to thread ribbon 5 through a tortuous pathway with many rollers, guides clips, etc., as is normally necessary with other types of cassettes or ribbon reels.

Removable tab 11 serves the function of providing a stiffener for the portion of ribbon 5 which passes beside it as can be seen to advantage in FIGS. 1 & 2. It serves to provide a stiffening and reinforcing action by means of leaves 17 so that this area of ribbon 5 can be easily placed between drive rollers 16, shown in phantom in FIG. 2, which are a part of the printing machine not shown. Once the cassette has been inserted in operative position and the ribbon 5 is between the rollers 16, tab 11 may be removed and discarded. Extension 23 on tab 11 keeps it from falling completely through the slot in cover 2 as shown in FIG. 1.

Turning to FIG. 2, a top view of the apparatus in FIG. 1 having cover 2 partially removed, is shown. Opening 13 is defined by guideways 4 and wall 26 is clearly shown in FIG. 2, as is the 180° twist in ribbon 5 which is maintained by guides 9 and 10 affixed to guideway 4. Individual U-shaped clips 8 are shown in position affixed to guideway 4 with ribbon 5 passing between the inner surface of a clip 8 and outer surface guideway 4. Shown in phantom lines are two rollers 16 which are part of the using apparatus not illustrated, which are driven by separate means to draw the ribbon 5 between them and stuff it into the body of cassette 1 through opening 21. The path of ribbon 5 as it passes along guideways 4 and behind the U-shaped clip 8 has been shown as being rather loose so that the ribbon 5 may be seen to advantage. It should be understood, however, that in use ribbon 5 would be pulled taut by the action of drive rollers 16 and would lie flat against guideways 4 throughout most of its path except for the area through guides 9 and 10, where the 180° twist in the longitudinal axis of ribbon 5 is maintained. Two cross-sectional portions of the apparatus in FIG. 2 have been illustrated in FIGS. 3 and 4, respectively.

Turning to FIG. 3, a cross-sectional view of guideway 4 looking towards a particular U-shaped guide clip 8 is shown. U-shaped clip 8 is provided with projecting cam surfaces 14 and small overhanging lip portions 18 to engage the back side or guide member 4. U-shaped clip 8 is held from slipping back and forth on guide 4 by individual molded projections 15 on the edges of guide 4 as shown. Ribbon 5 passes in the aperture left between the interior surface of clip 8 and the exterior surface of guideway 4. Instead of using individual clips 8 as separate parts, it is clear that they may be molded integrally with guides 4 as a convenience in assembling the cassettes. They might also be molded with a hinge attachment at one end to pivot into position on guides 4.

Turning to FIG. 4, a cross-sectional view taken perpendicular to the path of the tape through the nose portion 6 is shown. Aperture 7 is clearly visible and the path of ribbon 5 through the guide structure of nose 6 consisting of a small channel 19 behind the nose 6 and in front of posts 24 is clearly shown.

In FIG. 5 the insertion tab 11 illustrated in FIG. 1 in position through the cover 2 of cassette 1, is shown in greater detail. Tab 11 has connected leaf portions 17 which form a sandwich over a portion of ribbon 5 in the area between the two rollers 16 shown in FIG. 2 and serve to hold ribbon 5 in the proper position for insertion between rollers 16 which are mounted on the using equipment. That is, a leaf portion 17 of a tab 11 serves to stiffen and enfold the ribbon 5 and allow its easy insertion between the two rollers 16. Once ribbon 5 is in position between rollers 16 upon the loading of a new cassette in the using machine, rollers 16 contact ribbon 5 through the aperture between the tabs 17 which aperture has approximately the width of the tab portion 11 as shown in FIG. 5. Once ribbon 5 is engaged by the drive rollers, tab 11 may be pulled, withdrawing the entire assembly of sandwich structure members 17 and 11 from about ribbon 5 so that it is free to be drawn by rollers 16 into the cassette. As an alternate design, tab 11 may be molded of a single, flat piece with teeth like a comb; the ribbon may be interwoven between the teeth and the resulting stiffening and supporting action will be retained for inserting the ribbon between the drive rollers. Tip 23 keeps tab 11 from going through the slot in cover 2 as shown.

As will be immediately appreciated, particularly from the drawing FIG. 2, the operation of the cassette of the present invention is one of a continual withdrawal of the ribbon from the cassette 1 through opening 20. It moves past the nose aperture 7 where the printing mechanism inserted in the large central aperture 13 may then impact ribbon 5 and force it against any medium to be marked upon, not shown. The tape 5 is then drawn by the action of rollers 16 back into the cassette, through opening 21. It is folded or stuffed in more or less random or serpentine fashion on its transverse axis until it is eventually withdrawn. It is clear that it is not necessary for an operator inserting a cassette to thread or otherwise insert the inked ribbon 5 into any guideways or mechanical apparatus for guiding the ribbon which would necessitate inking one's fingers or soiling one's clothes, etc. Similarly, the extended guideways 4, provide a novel and advantageous aperture 13 or gap into which the printing mechanism may be inserted to impact the back side of ribbon 5 through aperture 7 and to drive ribbon 5 against a printing medium on the opposite side of aperture 7.

Friction block 25 serves to hold the ribbon 5 by its loop when the cassette is manufactured with ribbon 5 rolled in a coil. As the ribbon makes its first complete trip through the machine, the coil unwinds and the loop slips out from the gap 27 and lies as shown in FIG. 2. Block 25 is then no longer used or required.

The guides 4 are molded with a slight curvature between main body 1 and nosepiece 6, although the curvature of guide 4 where clips 8 are attached is very slight (on the order of 28 inches in radius). This curvature provides, in conjunction with molded pivot 28 in nosepiece 6 and with locating hole 29 and cam surface 30, a means of placing the guides 4 under tension when the cassette is inserted in a machine for use. This occurs because locating hole 29 slides over a fixed locating pin on the machine and the pin is tapered. Pivot 28 holds the nosepiece portion in the vertical and horizontal directions and resists tension in guides 4 produced by the action of the tapered pin in hole 29. This feature also makes allowance for slight molding dimensional changes in the finished part by allowing a slight stretching in guides 4 to be accommodated. The tension produced acts to hold the cassette in the machine as well. Cam surface 30 cooperates with means on the machine to move a lever mechanism for separating the drive rollers 16 for easier insertion of ribbon 5 between them. Hole 31 accommodates an axle or pivot for one of the rollers 16 which is movable by a mechanism not shown. The hole fits over a shouldered or headed axle on the drive roller which keeps the cassette firmly locked onto the machine.

While the invention has been shown and described with reference to a preferred embodiment thereof, it will be understood by those of skill in the art that the foregoing and other changes may be made therein without departing from the spirit and scope of the invention.

What is claimed is:

1. A cassette apparatus for an endless, randomly folded, loop of inked ribbon, or web, adapted for use in a printing device comprising:

a web storage compartment having walls and two parallel covers for containing the bulk of said endless loop folded randomly on its transverse axis; said storage compartment having separate inlet and outlet apertures in separate walls thereof for the ingress and egress of portions of said endless loop;

continuous loop guide means for guiding, supporting and confining the entire length of the path of a loop formed in said web external to said compartment;

said loop guide means extending from the point of egress of said loop in one said wall of said compartment to the point of ingress of said loop in another said wall of said compartment;

said guide means being affixed externally to said compartment at said egress and ingress locations in said walls, and enclosing, together with an external wall of said compartment lying between said ingress and egress location walls in said compartment, an enclosed area, the perimeter of said area being defined by said loop guide means and by said external compartment wall, said wall being between said ingress and egress location walls;

said apparatus further comprising means attached to said guide means external to said compartment for turning said web 180° about its longitudinal axis;

said guide means including an aperture therein for exposing both sides of a portion of said web to the outside environment adjacent said aperture in a direction perpendicular to the flat surfaces of said web.

* * * * *